US006457795B1

(12) United States Patent
Silverbrook

(10) Patent No.: US 6,457,795 B1
(45) Date of Patent: Oct. 1, 2002

(54) ACTUATOR CONTROL IN A MICRO ELECTRO-MECHANICAL DEVICE

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/556,217

(22) Filed: Apr. 24, 2000

(30) Foreign Application Priority Data

Apr. 22, 1999 (AU) ..... PP9930

(51) Int. Cl.[7] ..... B41J 29/38; B41J 2/14; B41J 2/04; B41J 2/16

(52) U.S. Cl. ..... 347/11; 347/47; 347/54

(58) Field of Search ..... 347/11, 54, 40, 347/44, 47

(56) References Cited

U.S. PATENT DOCUMENTS 3,683,212 A 8/1972 Zoltan ..... 310/8.3
3,857,049 A 12/1974 Zoltan ..... 310/8.3
5,825,383 A * 10/1998 Abe et al. ..... 347/54
6,000,785 A * 12/1999 Sakai et al. ..... 347/54
6,099,103 A * 8/2000 Takahashi ..... 347/11

FOREIGN PATENT DOCUMENTS

JP 10175316 A * 6/1998 ..... B41J/2/175

* cited by examiner

*Primary Examiner*—John Barlow
*Assistant Examiner*—Alfred E. Dudding

(57) ABSTRACT

A method of controlling liquid movement to and from a liquid ejection device (such as an ink jet printing device) having a nozzle chamber, a liquid ejection aperture in the nozzle chamber and a movable element located within the chamber for displacing liquid through the ejection aperture. The method comprises actuating the movable element so that it moves from a quiescent first position to a liquid ejecting second position with a first average velocity and so that it returns from the second position to the first position with a second average velocity lower than the first average velocity.

6 Claims, 5 Drawing Sheets

ACTUATOR CONTROL IN A MICRO ELECTRO-MECHANICAL DEVICE

FIELD OF THE INVENTION

The present invention relates to a method of controlling an actuator in a micro electro-mechanical device. The invention is herein described in the context of an ink jet printer but it will be appreciated that the invention does have application to other micro electro-mechanical devices such as micro electro-mechanical pumps.

BACKGROUND OF THE INVENTION

Micro electro-mechanical devices are becoming increasingly well known and normally are constructed by the employment of semi-conductor fabrication techniques. For a review of micro-mechanical devices consideration may be given to the article "The Broad Sweep of Integrated Micro Systems" by S. Tom Picraux and Paul J. McWhorter published December 1998 in IEEE Spectrum at pages 24 to 33.

One type of micro electro-mechanical device is the ink jet printing device from which ink is ejected by way of an ink ejection nozzle chamber. Many forms of the ink jet printing device are known. For a survey of the field, reference is made to an article by J Moore, "Non-Impact Printing: Introduction and Historical Perspective", Output Hard Copy Devices, Editors R Dubeck and S Sherr, pages 207–220 (1988).

A new form of ink jet printing has recently been developed by the present applicant, this being referred to as Micro Electro Mechanical Inkjet (MEMJET) technology. In one embodiment of the MEMJET technology, ink is ejected from an ink ejection nozzle chamber by a paddle or plunger which is moved toward an ejection nozzle of the chamber by an electro-mechanical actuator for ejecting drops of ink from the ejection nozzle chamber.

The present invention relates to a method of controlling an actuator of a type that is used in the MEMJET technology and other micro electro-mechanical devices.

SUMMARY OF THE INVENTION

The invention may be broadly defined as providing a method of controlling liquid movement to and from a liquid ejection device having a nozzle chamber, a liquid ejection aperture in the nozzle chamber and a movable element located within the chamber for displacing liquid through the ejection aperture. The method comprises actuating the movable element so that it moves from a quiescent first position to a liquid ejecting second position with a first average velocity and so that it returns from the second position to the first position with a second average velocity lower than the first average velocity.

The movable element preferably is displaced from the first to the second position by application of a primary energising pulse, and displacement of the movable element from the second position to the first position preferably is retarded by application of at least one secondary energising pulse having a duration that is less than that of the first energising pulse.

The invention may further be defined as providing a liquid ejection device comprising a nozzle chamber, a liquid ejection aperture in the nozzle chamber, a movable element located within the chamber for displacing liquid through the ejection aperture, an actuator for effecting displacement of the movable element from a quiescent first position to a liquid ejecting second position within the chamber. Also, means are provided for controlling actuation of the actuator in a manner to move the movable element from the first position to the second position with a first average velocity and to control return of the movable element from the second position to the first position at a second average velocity lower than the first average velocity.

The movable element in the liquid ejection device preferably comprises a paddle which, when moved from the first position to the second position, uncovers an opening through which the liquid passes for subsequent ejection from the aperture. Also the liquid ejection device preferably includes a series of baffles adjacent the opening to inhibit the back flow of liquid through the opening during movement of the paddle from the second position to the first position.

BRIEF DESCRIPTION OF THE DRAWINGS

Notwithstanding any other forms which may fall within the scope of the present invention, a preferred form of the invention will now be described, by way of example only, with reference to the accompanying drawings, in which.

DESCRIPTION OF PREFERRED EMBODIMENT

Figure 1:
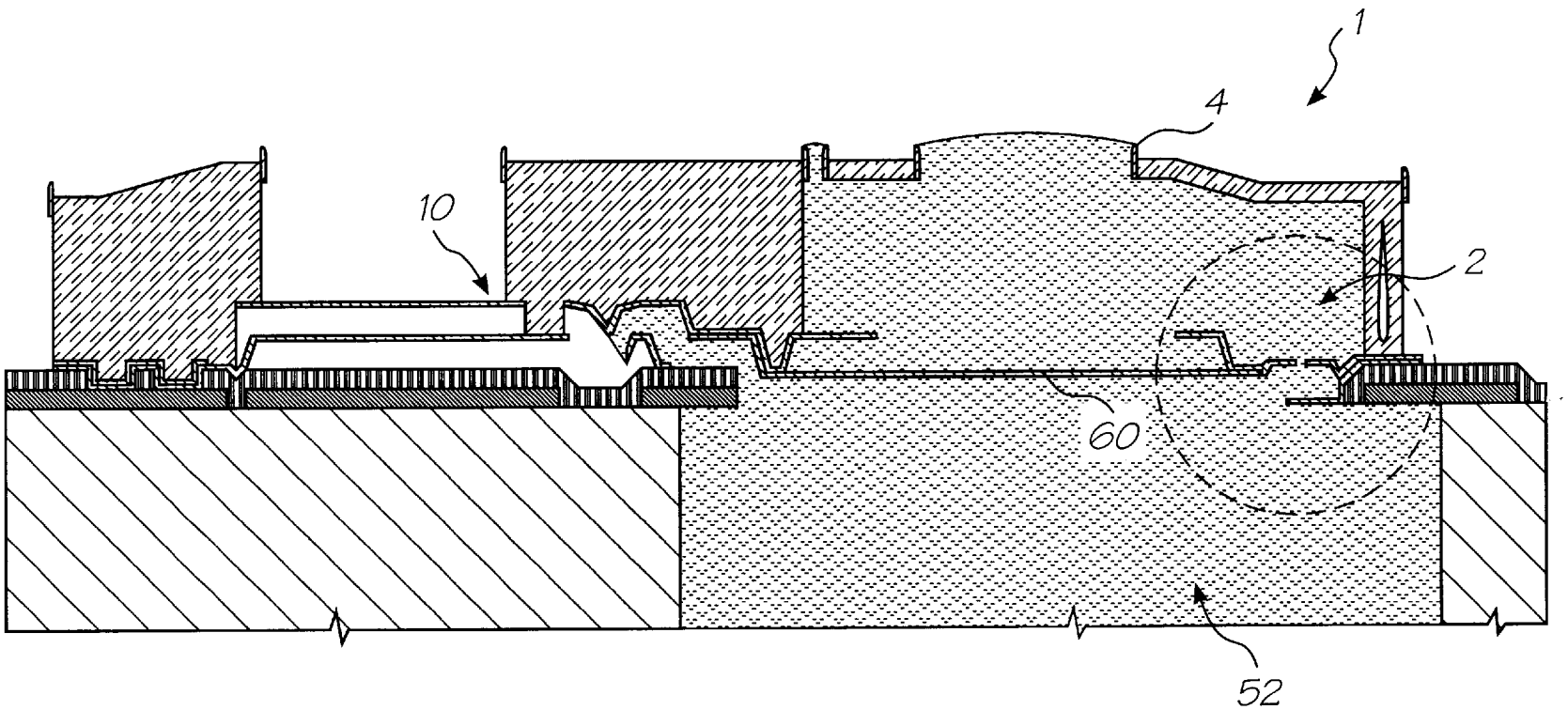
FIG. 1 illustrates a sectional view of a portion of an ink ejecting nozzle chamber of an ink jet printer.

FIG. 1 shows a device 1 for the ejection of ink. The device 1 comprises a nozzle chamber 2 and a paddle 60 located within the nozzle chamber 2 for ejecting ink from the chamber 2 through aperture 4. The paddle 60 is connected to a thermal actuator 10 which is employed to move the paddle 60 toward the aperture 4 for the ejection of ink and back into a quiescent first position.

Figure 1A:
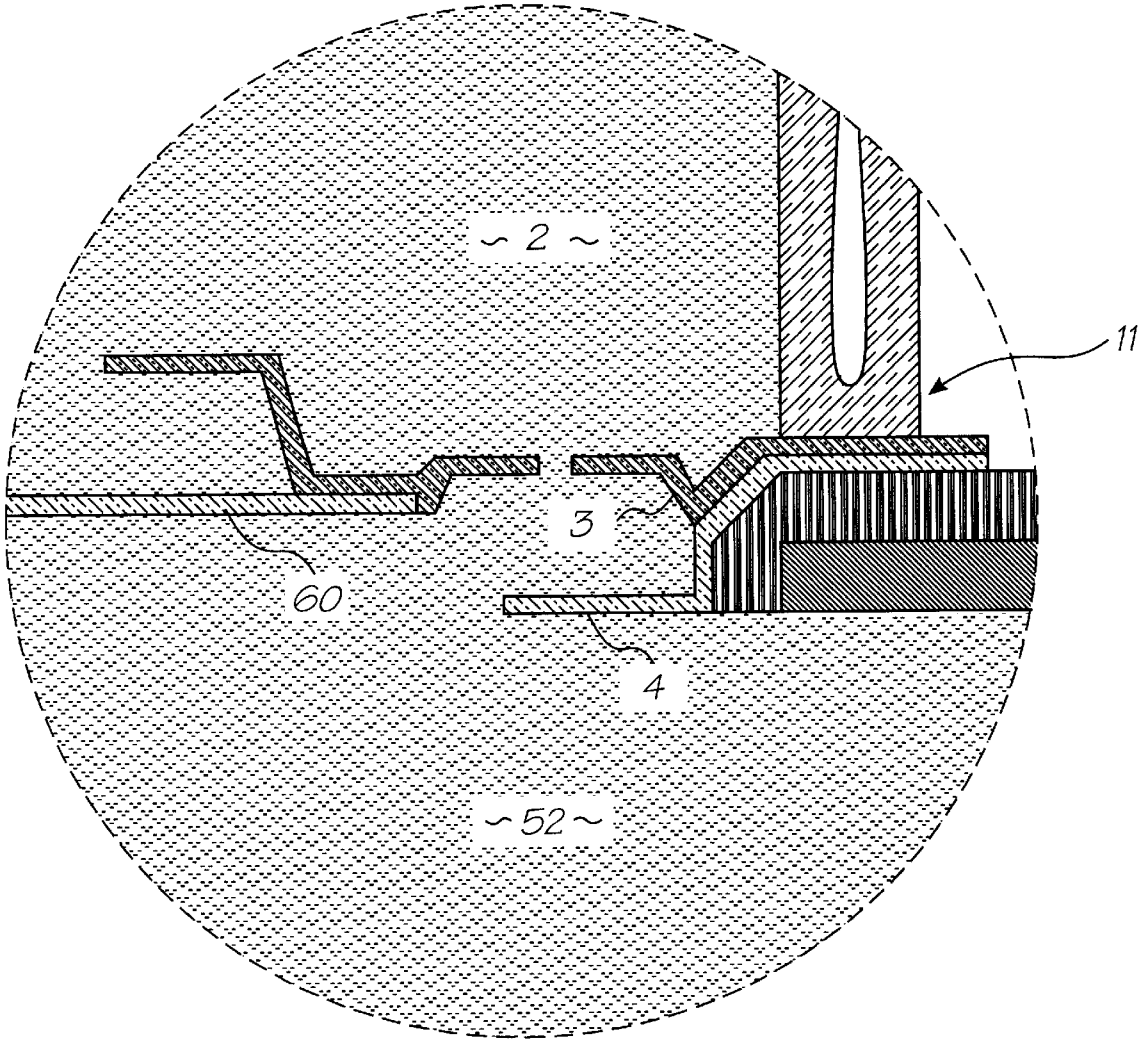
FIG. 1A illustrates a portion of the nozzle chamber of FIG. 1 with a paddle of the nozzle chamber shown in a quiescent first position.

FIG. 1A illustrates a detail of the device shown in FIG. 1. The nozzle chamber 2 has formed in a wall structure 11 thereof a nozzle chamber rim 3 and second rim 4. The paddle 60 is shown in the first position.

Figure 2:
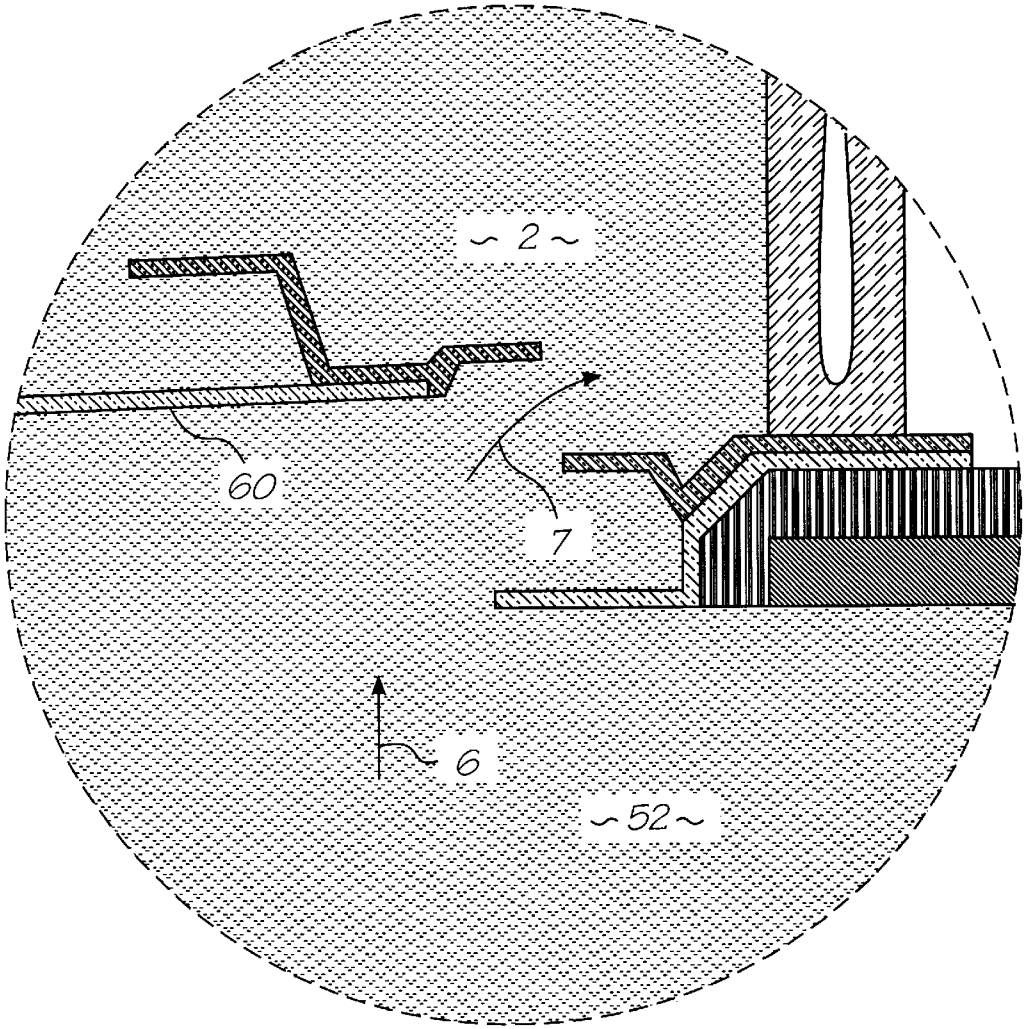
FIG. 2 illustrates a portion of the nozzle chamber of FIG. 1 with a paddle of the nozzle chamber shown in an ink ejecting second position.

Upon activation of the actuator 10, the paddle 60 is caused to move upwardly as illustrated in FIG. 2. This results in a rapid upward flow of ink behind the paddle 60 from the ink supply channel 52 as indicated by arrow 6. As an ink drop is ejected from the ink ejection nozzle, a corresponding amount of ink also flows into the nozzle chamber as indicated by arrow 7. This ink replenishes the nozzle chamber 2.

Figure 3:
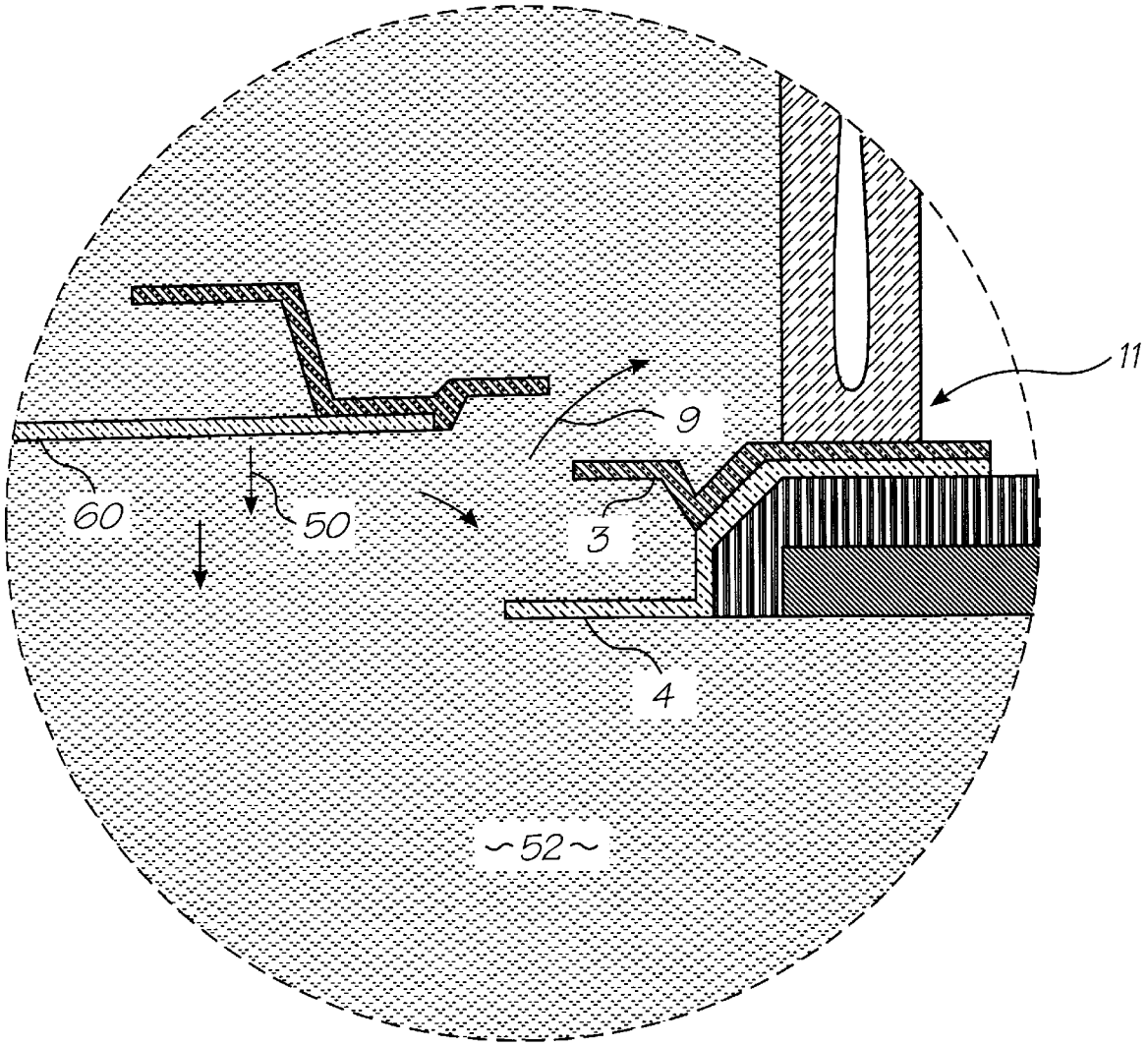
FIG. 3 illustrates a portion of the nozzle chamber of FIG. 1 with a paddle of the nozzle chamber shown returning to the quiescent first position.

Thereafter, the actuator is deactivated and, as illustrated in FIG. 3 the paddle 60 begins to move back to its quiescent position as indicated by arrow 50.

Because the wall structure 11 of the nozzle chamber comprises the series of rims 3 and 4, the back flow of liquid into the ink supply channel 52 is hindered. This facilitates the forward flow of ink into the nozzle chamber, as indicated by arrow 9, to replenish the ejected ink. Also, in order to further assist the forward flow of the ink in the direction of the arrow 9, the paddle 60 is moved back in a controlled manner as described below.

Figure 4:
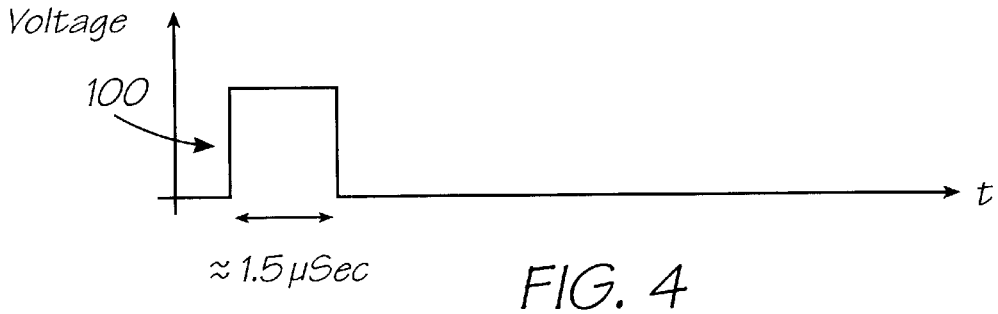
FIG. 4 is a drive voltage diagram applicable to voltage drive applied to a paddle actuator of the nozzle chamber.
Figure 5:
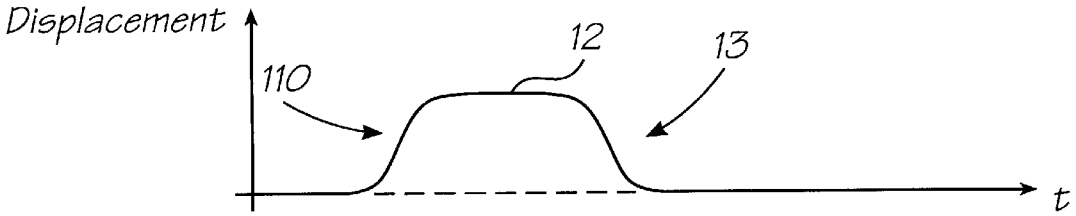
FIG. 5 shows a graph of displacement of the paddle actuator against time resulting from application of the drive voltage shown in FIG. 4.
Figure 6:
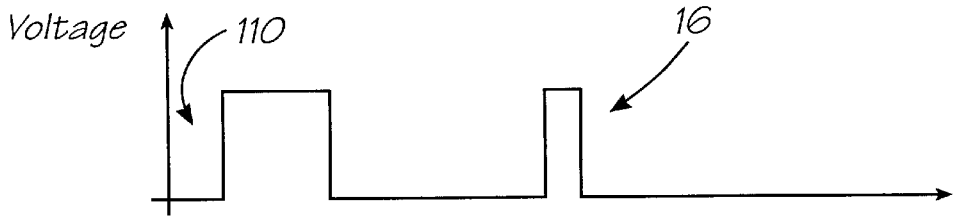
FIG. 6 is a drive voltage diagram applicable to voltage drive applied to the paddle actuator in accordance with a preferred form of the present invention.

FIG. 4 illustrates the form of a voltage pulse that might be employed to drive electrical current through the actuator 10. As is described in International Patent Application No. PCT/AU00/00095 filed on Feb. 11, 2000 by the present applicant, the electrical current induces heating in and, as a consequence, bending of the actuator 10 to move the paddle 60 from the first to the second position. The voltage and, as a consequence, current pulse 100 as shown in FIG. 4 for driving the actuator 10 would normally occupy a 1.5 microsecond period. The displacement of the actuator and, hence, the paddle rises sharply to a maximum level indicated by numeral 12 in FIG. 5 and, thereafter, falls at substantially the same rate, as indicated by numeral 13 in FIG. 5 following expiration of the voltage pulse period. The average velocity of displacement of the paddle 60 in moving from the second position to the first position is substantially equal to the average velocity of displacement of the paddle from the first position to the second position.

In the preferred embodiment of the present invention, the return rate of displacement of the actuator 10 and, hence, the paddle 60 is slowed and this is achieved by applying a further drive voltage (and hence current) pulse 16 of shorter duration to the actuator 10. This has the effect of extending the displacement time for or, in other words, reducing the average velocity of the return of the paddle 60 from the second to the first position, as indicated by numeral 17 in FIG. 7.

Figure 7:
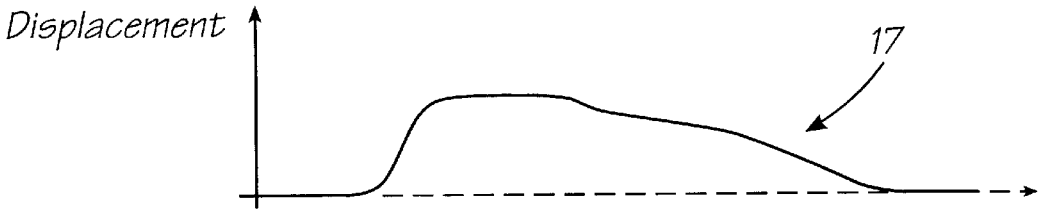
FIG. 7 shows a graph of displacement of the paddle actuator against time resulting from application of the drive voltage shown in FIG. 6.

It will be understood that the displacement plot as shown in FIG. 7 may be further extended to meet specific requirements by generating a series of the short duration pulses 16 following generation of the relatively longer pulse 110.

The slow return of the paddle 60 to its quiescent first position (relative to the more rapid movement of the paddle 60 toward the second position) permits an increased flow of the ink into the nozzle chamber, this resulting from a reduced back-pressure being applied to the ink flowing into the chamber from the inlet channel 52.

Whilst the embodiment of the invention has been described above with reference to an ink ejection system that utilises a thermally activated actuator 10, other types of actuators might alternatively be employed. For example, a piezo-electric actuator or a shape-memory alloy actuator may be employed as an alternative to the thermal actuator. Under these circumstances the actuators may be controlled in a different manner from that which is described above but still with the purpose of increasing the displacement time during the closing motion and, hence, varying the velocity of movement in the respective directions.

Other variations and modifications may be made in respect of the invention as above described without departing from the scope of the invention as defined in the appended claims.

What is claimed is:

1. A method of controlling liquid movement to and from a liquid ejection device having a nozzle chamber, a liquid ejection aperture in the nozzle chamber and a movable element located within the chamber for displacing liquid through the ejection aperture; the method comprising actuating the movable element so that it moves from a quiescent first position to a liquid ejecting second position with a first average velocity and so that it returns from the second position to the first position with a second average velocity lower than the first average velocity, wherein the movable element is displaced from the first to the second position by application of a primary energising pulse and displacement of the movable element from the second position to the first position is retarded by application of at least one secondary energising pulse having a duration that is less than that of the first energising pulse.

2. A liquid ejection device comprising a nozzle chamber, a liquid ejection aperture in the nozzle chamber, a movable element located within the chamber for displacing liquid through the ejection aperture, an actuator for effecting displacement of the movable element from a quiescent first position to a liquid ejecting second position within the chamber, and means for controlling actuation of the actuator in a manner to move the movable element from the first position to the second position with a first average velocity and to control return of the movable element from the second position to the first position at a second average velocity lower than the first average velocity, wherein the actuator is displaced from the first to the second position by application of a current pulse for a first duration and wherein the actuator is permitted to recover following expiration of the first duration and wherein recovery of the actuator is delayed by application of a second current pulse for a duration shorter than that of the first current pulse.

3. A liquid ejection device comprising a nozzle chamber, a liquid ejection aperture in the nozzle chamber, a movable element located within the chamber for displacing liquid through the ejection aperture, an actuator for effecting displacement of the movable element from a quiescent first position to a liquid ejecting second position within the chamber, and means for controlling actuation of the actuator in a manner to move the movable element from the first position to the second position with a first average velocity and to control return of the movable element from the second position to the first position at a second average velocity lower than the first average velocity, wherein the movable element comprises a paddle which, when moving from the first position to the second position, uncovers an opening through which the liquid passes for subsequent ejection from the aperture.

4. The liquid ejection device as claimed in claim 3 wherein the actuator comprises a thermal actuator which is coupled to the paddle and which is actuated with passage of electrical current to effect displacement of the paddle.

5. The liquid ejection device as claimed in claim 4 wherein the actuator is caused to bend so as to displace the paddle.

6. The liquid ejection device as claimed in claim 3 wherein a series of baffles is provided adjacent the opening to inhibit the back flow of liquid through the opening during movement of the paddle from the second position to the first position.

* * * * *